US005577719A

United States Patent [19]

Nicoll

[11] Patent Number: 5,577,719

[45] Date of Patent: Nov. 26, 1996

[54] DOCUMENT ALIGNMENT SYSTEM

[75] Inventor: Kenneth A. Nicoll, Birkhill, Scotland

[73] Assignee: NCR Corporation, Dayton, Ohio

[21] Appl. No.: 311,245

[22] Filed: Sep. 23, 1994

[30] Foreign Application Priority Data

Nov. 15, 1993 [GB] United Kingdom ..... 9323710

[51] Int. Cl.[6] ..... B65H 7/02

[52] U.S. Cl. ..... 271/227; 271/250; 271/274

[58] Field of Search ..... 271/227, 228, 271/248, 250, 251, 252, 272, 274

[56] References Cited

U.S. PATENT DOCUMENTS

| | | | |
|---|---|---|---|
| 4,143,755 | 3/1979 | Keller | 271/250 |
| 4,438,918 | 3/1984 | Ito et al. | 271/251 |
| 5,136,144 | 8/1992 | Swinton et al. | 271/227 |
| 5,251,893 | 10/1993 | Schoenhenz | 271/274 |
| 5,280,901 | 1/1994 | Smith et al. | 271/250 |

FOREIGN PATENT DOCUMENTS

| | | | |
|---|---|---|---|
| 0473884 | 5/1991 | European Pat. Off. . | |
| 0496398 | 1/1992 | European Pat. Off. . | |
| 512886 | 11/1930 | Germany . | |
| 9210105 | 12/1992 | Germany . | |
| 0062138 | 4/1982 | Japan | 271/251 |
| 0183551 | 10/1983 | Japan | 271/250 |

*Primary Examiner*—H. Grant Skaggs
*Attorney, Agent, or Firm*—Elmer Wargo

[57] ABSTRACT

A document alignment system includes a plurality of drive rolls (42, 44) operative to drive documents one by one along a feed path, and a plurality of alignment rolls (100) spaced apart along the feed path with their axes perpendicular to those of the drive rolls (42,44) and operative to move a document (124) transversely to the feed path so as to bring a long edge of the document (124) into parallel abutting contact with a reference surface (72). When the alignment rolls are operative the drive rolls (42) are inoperative and out of contact with the document (124). Each alignment roll (100) is arranged to cooperate with a spring biased rotatably mounted ball (112) whereby in the course of an alignment operation the document (124) is gripped resiliently between the alignment rolls (100) and the cooperating balls (112).

10 Claims, 6 Drawing Sheets

DOCUMENT ALIGNMENT SYSTEM

BACKGROUND OF THE INVENTION

This invention relates to a document alignment system.

The invention has application, for example, to a depository apparatus included in an automated teller machine (ATM) of the kind which is arranged to carry out a financial transaction, such as dispensing currency notes or accepting a deposit in the form of an envelope or a single sheet financial document such as a cheque or payment slip. As is well known, in operation of an ATM of this kind, a user inserts a customer identification card into the machine and then enters certain data (such as a personal identification number, type of transaction, etc.) on one or more keyboards included in a user interface of the machine. The machine will then process the transaction, dispense currency notes or accept a deposit item as may be requested, and return the card to the user as part of a routine operation. If a financial document is deposited, the document is transported to reading and printing means for automatic processing of the document, after which the document is deposited in container means.

In an automatic document processing system in which a document is fed past reading means or printing means arranged to read information carried on the document, or to print information at predetermined locations on the document, it is important that the document is accurately aligned relative to the document feed path so that correct reading or printing takes place.

From EP-A-0473884 there is known a document alignment system for use in a printer in which documents are aligned relative to a feed path by bringing each document into parallel abutting contact with a reference surface parallel to the feed path. This known system includes first and second drive rolls respectively associated with a pinch roll and a wobble roll. The pinch roll is selectively brought into cooperative relationship with the first drive roll for the purpose of driving a document along the feed path, and the wobble roll is selectively brought into cooperative relationship with the second drive roll for the purpose of moving the document into abutting relationship with the reference surface, the wobble roll being in a non-operative position with respect to its associated drive roll when the pinch roll is in an operative position with respect to its associated drive roll, and vice versa. In the course of an alignment operation, the relevant drive roll is driven forwards and backwards a number of times, the axis of the wobble roll pivoting with each reversal of movement in such a sense as to tend to pull the document towards the reference surface. A disadvantage of this known system is that it is necessary to drive the wobble roll back and forth two or three times in order to bring the document into a parallel abutting contact with the reference surface.

SUMMARY OF THE INVENTION

It is an object of the present invention to provide a document alignment system which is of simple construction and is rapid and reliable in operation.

According to the invention there is provided a document alignment system including drive means operative to drive documents one by one along a feed path, and alignment means operative to bring an edge of each document into parallel abutting contact with a reference surface parallel to said feed path, said alignment means being operative when said drive means is non-operative and being non-operative when said drive means is operative, characterized in that said alignment means includes a plurality of alignment rolls spaced apart in a direction parallel to said feed path and being mounted with their axes non-perpendicular to said feed path, and a plurality of spring biased, rotatably mounted balls respectively arranged to cooperate with said alignment rolls, said alignment rolls being arranged to be driven in the course of an alignment operation so as to drive a document towards said reference surface with the document gripped resiliently between said alignment rolls and said balls.

A document alignment system in accordance with the invention will now be described by way of example with reference to the accompanying specification claims and drawing.

DETAILED DESCRIPTION OF A PREFERRED EMBODIMENT

Figure 1:
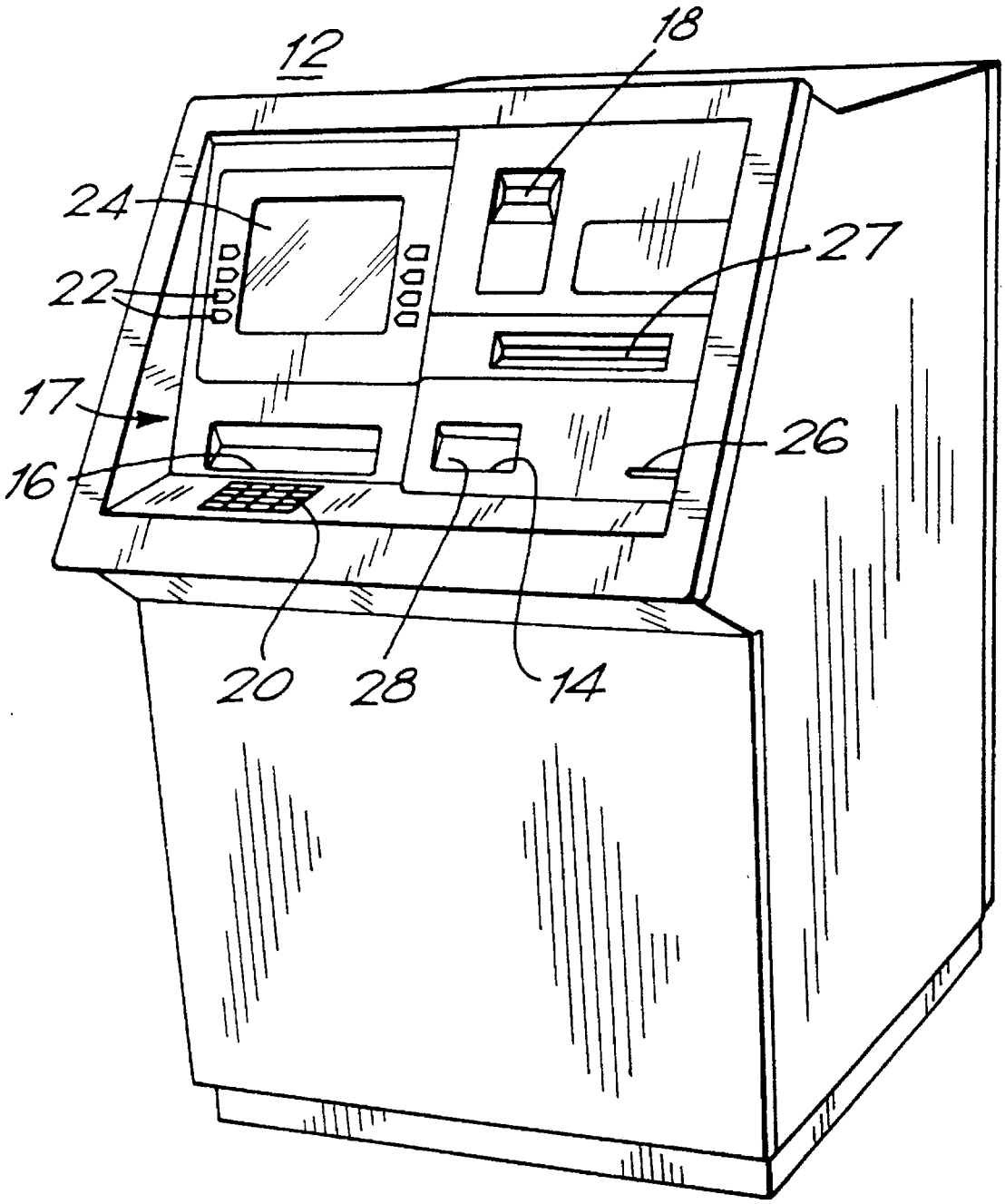
FIG. 1 is a perspective view of an ATM incorporating a depository apparatus.

Referring to the drawings, a depository 10 is incorporated in an ATM 12 adapted to accept deposit items, represented by envelopes containing money (currency notes and/or cheques) or single sheet financial documents such as cheques or payment slips, through an entry slot 14, and to dispense currency notes through a slot 16, the slots 14 and 16 being included in a user interface 17 of the ATM 12. It should be noted that, in the following description, the term deposit item will be used to mean a deposited envelope or single sheet financial document. The user interface 17 also includes a card entry slot 18 through which a user of the machine inserts a customer identification card, a keyboard 20 and control keys 22 on which the user enters data such as a personal identification number (PIN) and the required transaction details, a lead-through display screen 24 on which user instructions and other information are displayed, a receipt slot 26 through which receipts are issued to a user, and a slot 27 through which envelopes are dispensed on request to a user.

Figure 6:
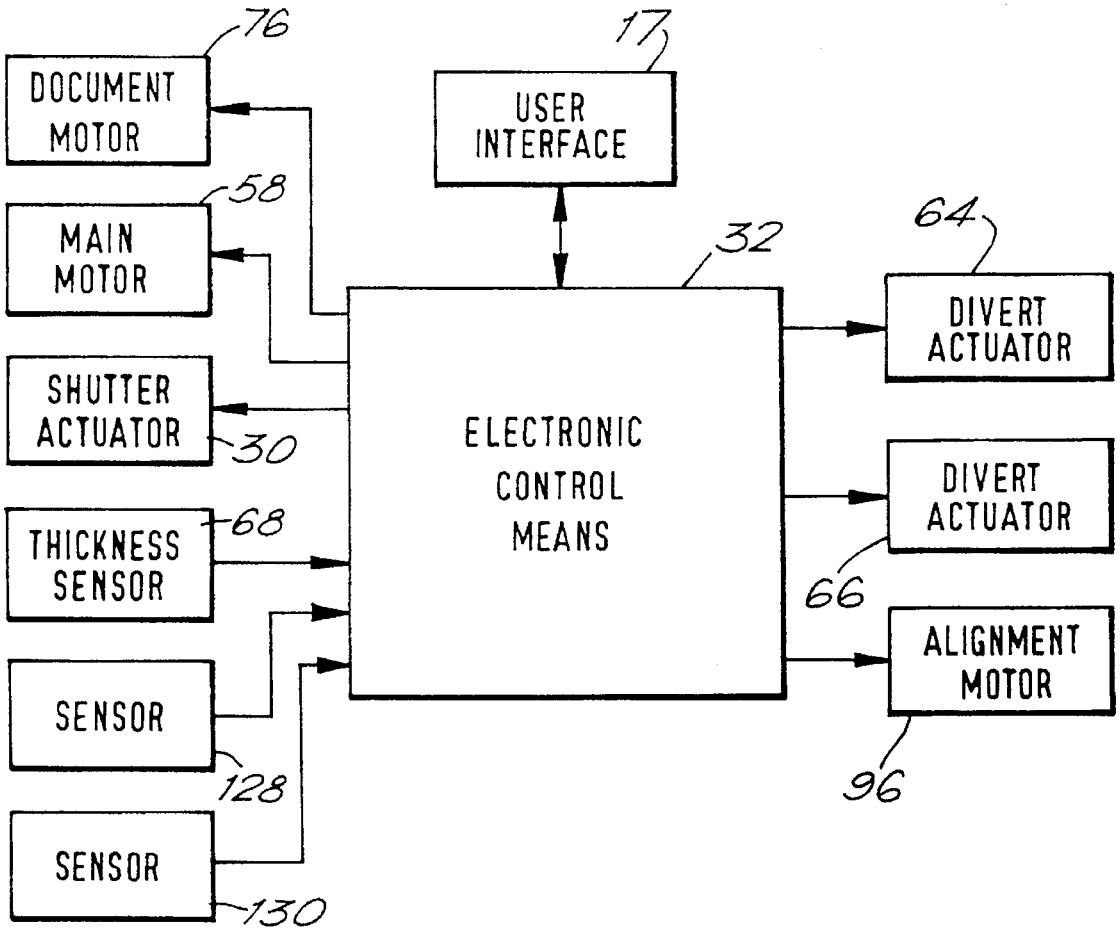
FIG. 6 is a schematic block diagram illustrating the electrical interconnections of parts of the depository apparatus.

The entry slot 14 for deposit items is normally closed by a shutter 28 (not shown in FIG. 2A) connected to an actuating mechanism 30 (FIG. 6). Operation of the actuating mechanism 30 serves to retract the shutter 28 from its closed position so as to permit deposit items to be inserted in the depository 10 through the slot 14. Operation of the actuating mechanism 30 along with operation of other elements of the ATM 12 is controlled by electronic control means 32 as indicated in FIG. 6.

Figure 2A:
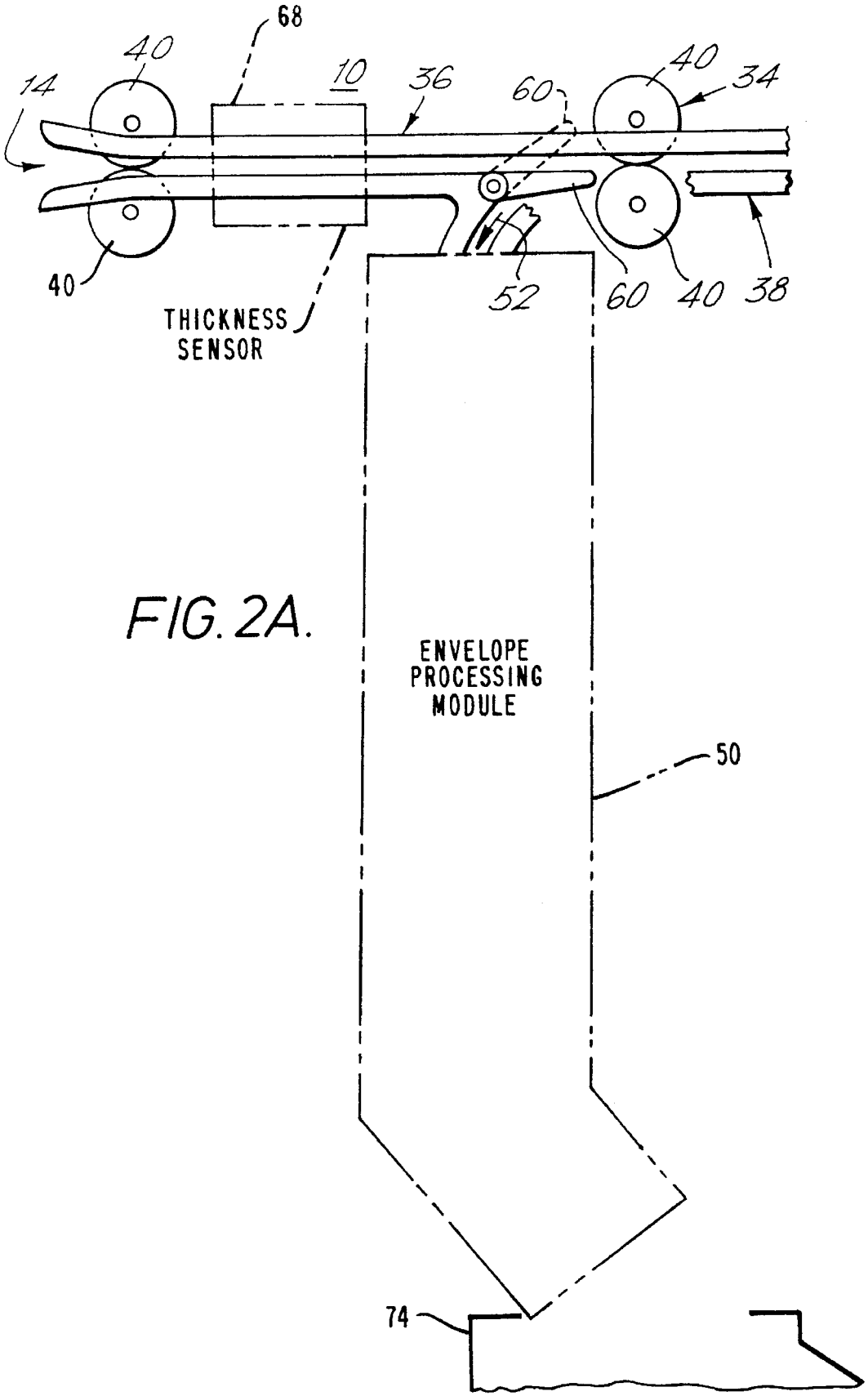
FIGS. 2A and 2B taken together are a schematic side elevational view of the depository apparatus.
Figure 2B:
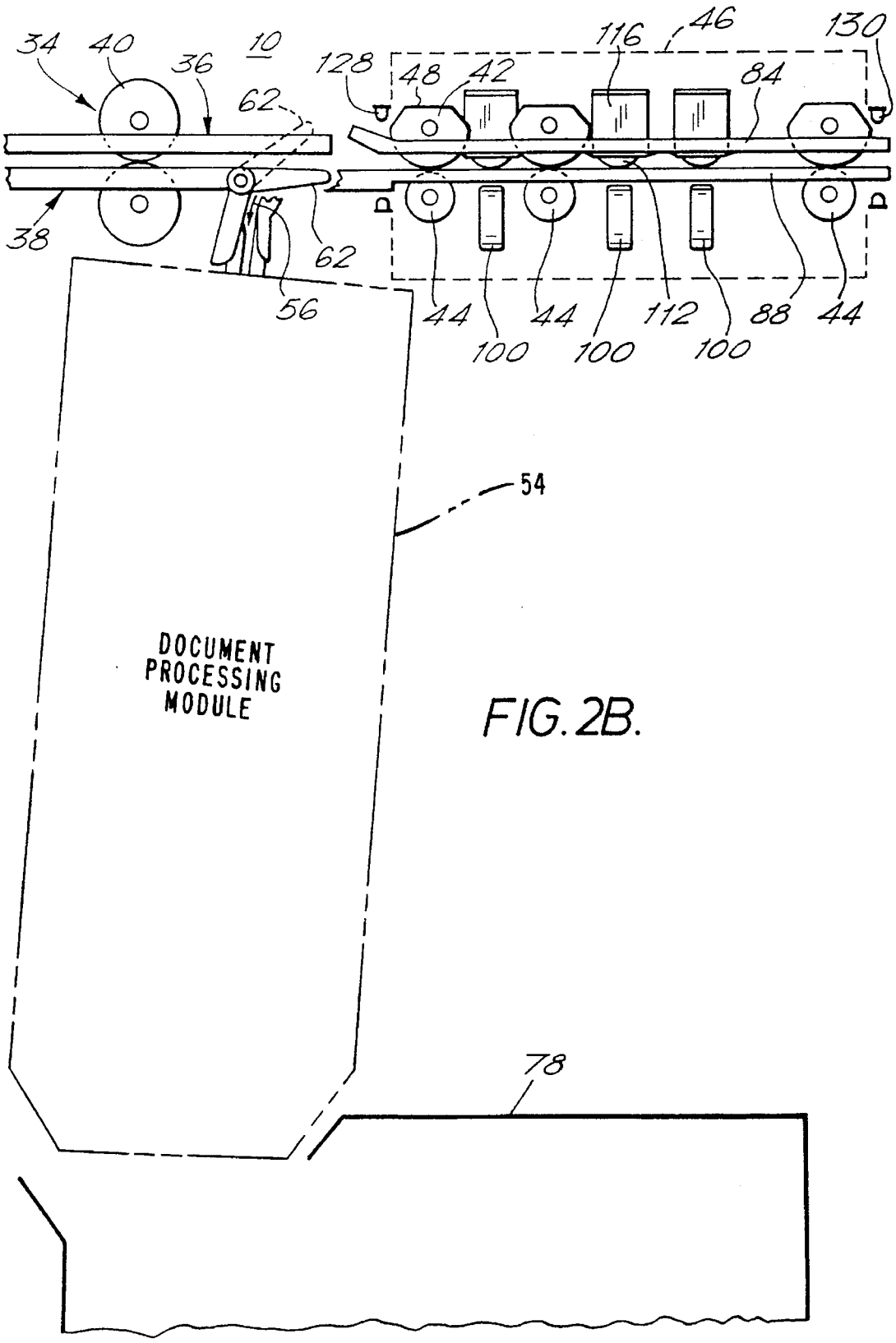

Referring now particularly to FIGS. 2A and 2B, the depository 10 has a transport mechanism which includes a common transport section 34 for transporting deposit items from the entry slot 14 along a common feed path defined by upper and lower guide means 36 and 38. The common transport section 34 includes a plurality of cooperating pairs of drive rolls 40, and further drive rolls 42 which cooperate with idler rolls 44, the rolls 40, 42 and 44 all being of compressible rubber. The rolls 42 and 44 are included in an alignment mechanism 46 in accordance with the present invention and, as will be described in more detail later, each of the rolls 42 includes a flat peripheral portion 48. Envelope and document feed paths branch off from the common feed path, the envelope feed path leading to an envelope processing module 50 as indicated by arrow 52, and the document feed path leading to a document processing module 54 as indicated by arrow 56. The drive rolls 40 and 42 are driven by a main reversible transport motor 58 (FIG. 6). A pivotably mounted divert gate 60 is positioned at the junction between the common feed path and envelope feed path, and a further pivotably mounted divert gate 62 is positioned at the junction between the common feed path and the document feed path. The divert gates 60 and 62 are normally in the home positions shown in solid outline in FIGS. 2A and 2B, but are each selectively movable to an actuated position shown in chain outline under the control of a respective associated actuator 64 or 66 (FIG. 6).

A thickness sensor 68 is positioned adjacent to the entry slot 14 of the depository 10, the sensor 68 being arranged to detect whether a deposit item has a thickness of at least one millimeter, which in the present embodiment is taken as being indicative that the deposit item is an envelope. If the thickness sensor 68 senses that a deposited item has a thickness of at least one millimeter, then it sends an appropriate output signal to the electronic control means 32. The thickness sensor 68 may be of known construction and operation. For example, the thickness sensor 68 may include two cooperating rolls (not shown) which are moved apart as a deposit item passes between them, the above-mentioned output signal being generated if the rolls are moved apart by at least one millimeter.

The alignment mechanism 46 is positioned adjacent to the end of the common feed path remote from the entry slot 14. As will be explained in more detail later, the alignment mechanism 46 serves to align a deposit item which is a single sheet financial document by moving the document transversely relative to the common feed path so as to bring a long edge of the document into parallel abutting contact with a reference surface 72 (FIGS. 4 and 5) which is accurately parallel to the document feed path, the reference surface 72 forming part of the inner surface of a side frame of the depository 10. When a document has been correctly aligned in this manner, it has the correct orientation relative to the document feed path so that it is processed correctly as it is fed through the document processing module 54.

If the thickness sensor 68 indicates that the deposit item is an envelope, the divert gate 62 remains in its home position but the divert gate 60 is moved to its actuated position as shown in dashed outline in FIG. 2A. The operation of the motor 58 is then reversed so as to cause the common transport section 34 to move the envelope back along the common feed path towards the entry slot 14. Before reaching the entry slot 14, the envelope is diverted by the diverter gate 60 into the envelope processing module 50. In the envelope processing module 50 there is printed on the envelope appropriate information such as a serial number identifying the envelope, time and date. After passing through the module 50, the envelope is deposited in an envelope bin 74.

If the thickness indicator 68 indicates that a deposit item is considered to be a single sheet document (i.e. that it has a thickness of less than one millimeter), then after the deposit item has been transported to the rightmost position along the common feed path the divert gate 62 is moved to its actuated position as shown in dotted outline. After having been aligned, the deposit item is moved by the common transport section 34 back along the common feed path towards the entry slot 14. Shortly after this reverse movement commences, the deposit item is diverted by the divert gate 62 into the document processing module 54. Included in the document processing module 54 are sensor means (not shown) for sensing whether the deposit item is correctly aligned. If the deposit item is not correctly aligned, the operation of a document transport motor 76 (FIG. 6) included in the module 54 is reversed so as to feed the item back to the alignment mechanism 46 where the alignment operation is repeated. The procedure of aligning a deposit item and checking its alignment is repeated, if necessary, up to three times. If after three repeated alignment procedures the deposit item is still not correctly aligned, it is either fed back by the common transport section 34 along the common feed path to the entry slot 14 for collection by the user, or the item is diverted by the divert gate 60 into the envelope processing module 50 for feeding to the envelope bin 74 from where it can be collected for manual processing.

If after entering the document processing module 54, a deposit item is found to be correctly aligned, the item is scanned automatically in known manner in order to determine whether it fulfills the criteria of being a financial document of predetermined type, of being correctly oriented, and of being fully completed. If the deposit item does not fulfill these criteria, then the document transport motor 76 is reversed so as to return the item to the common transport path, after which the item is fed back to the entry slot 14 or fed to the envelope bin 74, as in the case of a misaligned item. If the deposit item does fulfil the above-mentioned criteria, then information carried by the item is processed in known manner by the module 54, and appropriate information (e.g. serial number identifying the document, date, time and ATM location) is printed on the document. Finally, the document is fed to a document bin module 78 where the document is stacked in an orderly manner in an appropriate pocket of the bin module 78.

Figure 3:
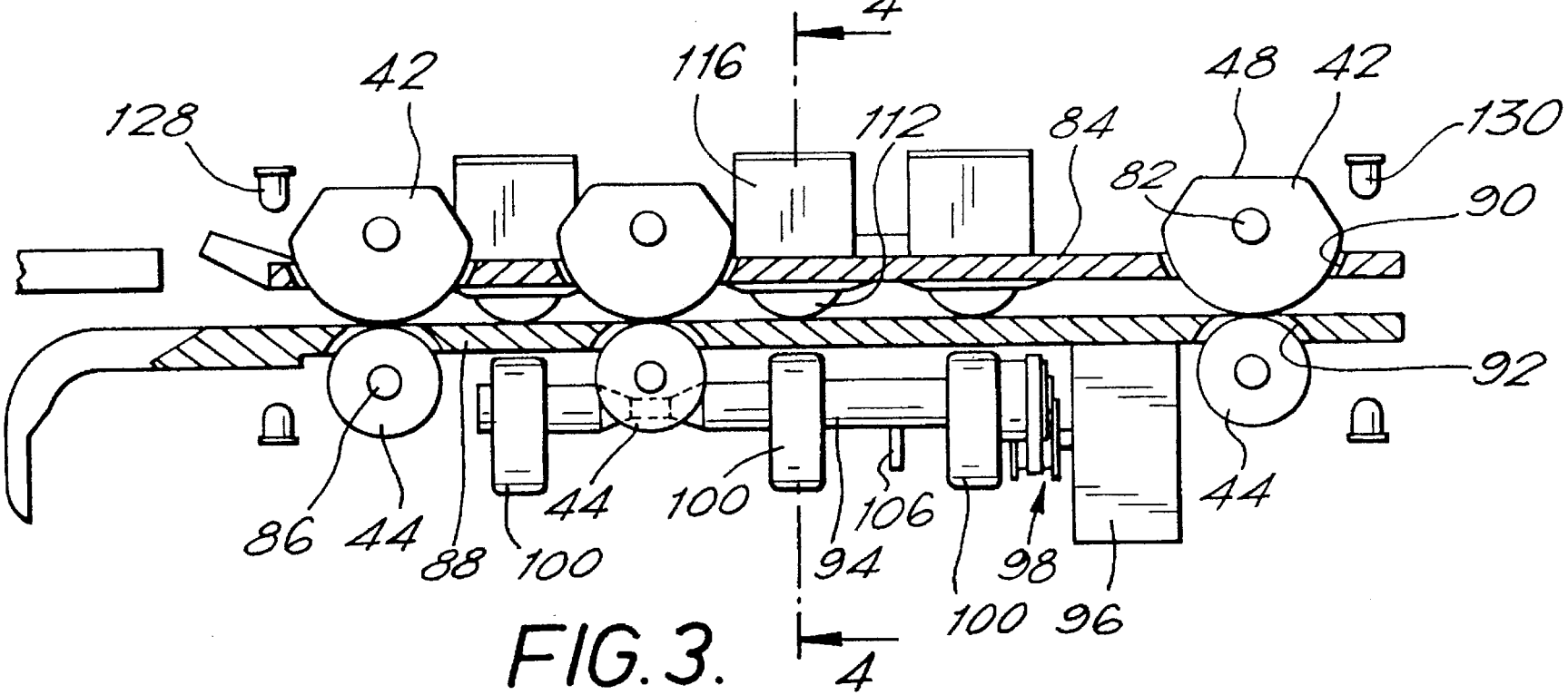
FIG. 3 is an enlarged part sectional side elevational view of an alignment mechanism of the depository apparatus, showing additional elements not shown in FIG. 2B.
Figure 4:
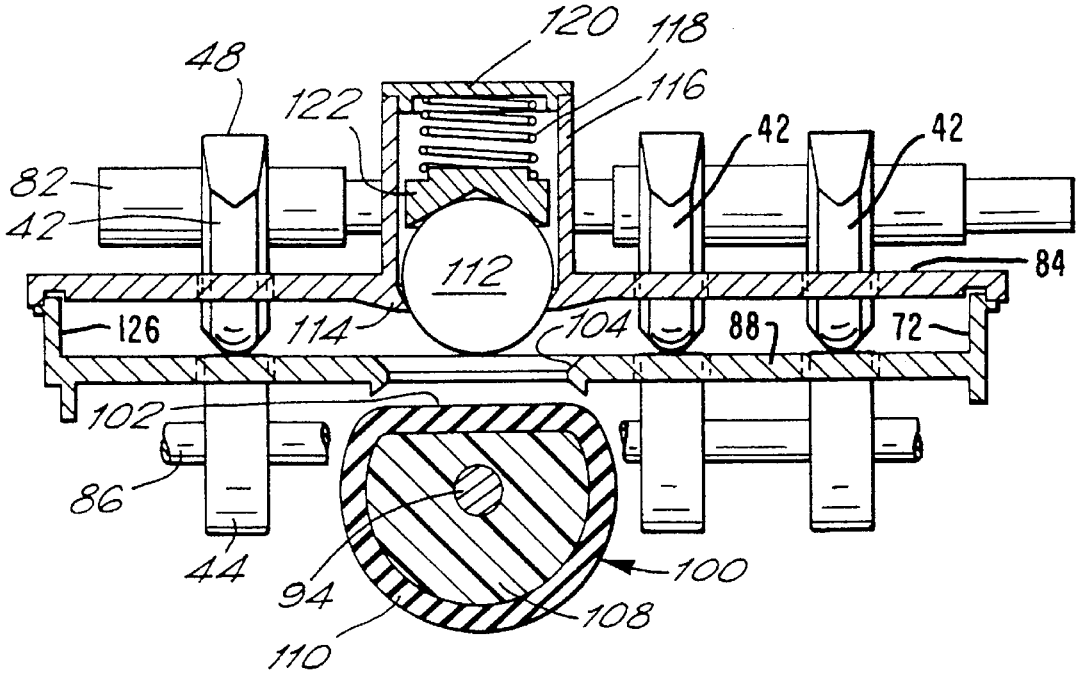
FIG. 4 is a still further enlarged part sectional view taken across the alignment mechanism of FIG. 3, the section being taken along the line 4—4 of FIG. 3, with drive and alignment rolls of the alignment mechanism being shown in an operative and non-operative condition respectively.
Figure 5:
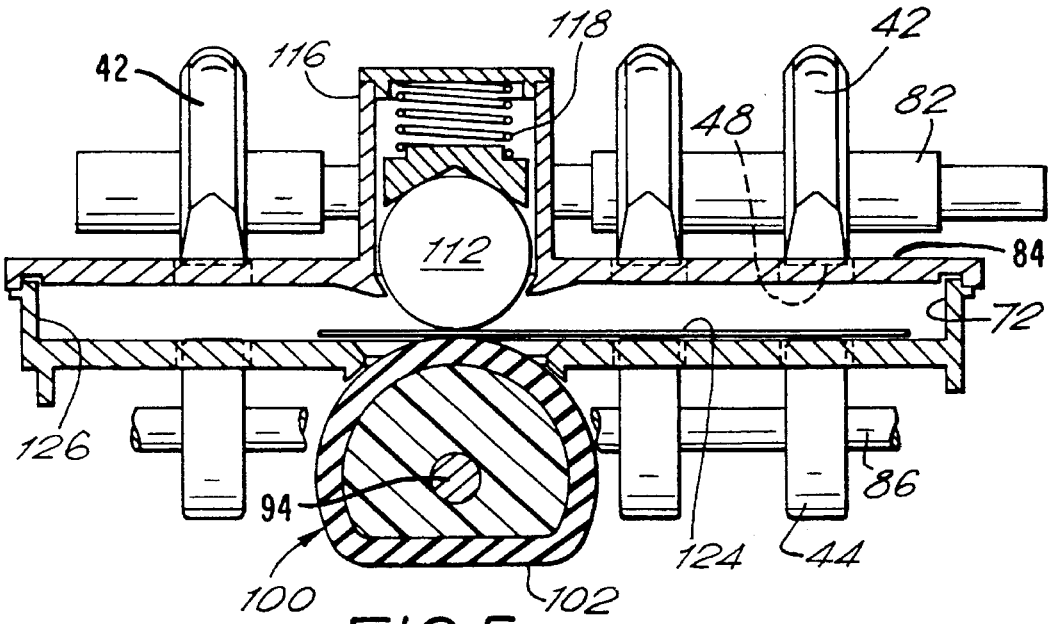
FIG. 5 is a view similar to FIG. 4, but showing the drive and alignment rolls in a non-operative and operative condition respectively.

Referring now additionally to FIGS. 3 to 5 as previously mentioned, the drive rolls 42 and the cooperating idler rolls 44 are included in the alignment mechanism 46. The drive rolls 42 and the idler rolls 44 are arranged in three sets of three rolls. The drive rolls 42 of each set are secured on a respective drive shaft 82 which extends transversely to the common feed path above a plate member 84 forming part of the upper guide means 36, and the idler rolls 44 of each set are rotatably mounted on a respective shaft 86 which extends transversely to the common feed path below a table 88 forming pan of the lower guide means 38. As shown in FIGS. 2B and 3, the axes of the drive shafts 82 lie in the same horizontal plane and are spaced apart along the common feed path, and the axes of the shafts 86 also lie in a common horizontal plane and are respectively disposed immediately below the axes of the shafts 82. The drive shafts 82 are driven in unison by the main transport motor 58, and the drive rolls 42 are mounted on the shafts 82 such that all the flat peripheral portions 48 have the same orientation. As the drive rolls 42 rotate they respectively extend through slots 90 (FIG. 3) formed in the plate member 84. Similarly, the idler rolls 44 are respectively partially disposed in slots 92 formed in the table 88, with the uppermost parts of the peripheries of the rolls 44 being level with the upper surface of the table 88. As a deposit item is driven along the common feed path in the region of the alignment mechanism 46 it is gripped between the idler rolls 44 and the arcuate parts of the periphery of the drive rolls 42. Immediately prior to the alignment mechanism 46 being operated for the purposes of bringing a long edge of a deposit item into parallel abutting contact with the reference surface 72, rotation of the rolls 42 and 44 is stopped with the flat peripheral portions 48 of the rolls 42 facing downwards and out of contact with the rolls 44. In order to ensure that the rolls 42 are stopped with the flat peripheral portions 48 facing downwards, one of the drive shafts 82 carries a flag formed by an extension (not shown) arranged to be sensed by sensor means (not shown) which applies signals to the electronic control means 32.

Disposed beneath the table 88 and extending in a horizontal direction parallel to the common feed path is a further drive shaft 94 which is driven by a reversible motor 96 via transmission means 98. Three transverse drive rolls 100, hereinafter referred to as alignment rolls 100, are secured on, and spaced apart along, the shaft 94. As shown in FIGS. 2B and 3, one of the alignment rolls 100 is located between the intermediate idler roll 44 and that idler roll 44 nearest the entry slot 14, while the other two alignment rolls 100 are disposed between the intermediate idler roll 44 and that idler roll 44 furthest from the entry slot 14. Each of the alignment rolls 100 has a flat peripheral portion 102. The alignment rolls 100 are mounted on the shaft 94 so that at any instant all the flat peripheral portions 102 of the rolls 100 lie in the same plane. As the rolls 100 rotate, the arcuate portions of the peripheries thereof are respectively partially accommodated in three slots 104 formed in the table 88, with the uppermost parts of these arcuate portions extending slightly above (by 0.5 millimeter) the upper surface of the table 88. When rotation of the rolls 100 is stopped, the flat peripheral portions 102 are uppermost and disposed just below the lower surface of the table 88. In order to ensure that the rolls 100 are stopped with the flat peripheral portions 102 uppermost, the shaft 94 carries a flag represented by an extension 106 arranged to be sensed by sensor means (not shown) which applies signals to the electronic control means 32.

Referring now particularly to FIGS. 4 and 5, each of the alignment rolls 100 comprises an inner member 108 of hard plastic material around which is formed a sleeve 110 of compressible rubber. Each roll 100 is cooperatively associated with a respective spring biased ball 112 of hard plastic material which is seated in an annular holding portion 114 of the table 88, the annular portion 114 forming the lower end of a cylindrical housing 116 for the ball 112. In the absence of a deposit item in the alignment mechanism 46 and with the rolls 100 stationary with the flat peripheral portions 102 uppermost, each ball 112 is urged by a respective compression spring 118 into engagement with the respective holding portion 114, with the lowermost portion of the ball 112 being level with the upper surface of the table 88 and opposite the respective roll 100 as shown in FIG. 4. Each compression spring 118 extends vertically inside the respective housing 116 between a closed upper end 120 of the housing 116 and a plastic member 122 which engages with the respective ball 112. It should be understood that each ball 112 is held in the respective housing 116 between the plastic member 122 and the annular portion 114 so as to be rotatable relative to the plate member 84.

Prior to the commencement of an alignment operation, rotation of the drive rolls 42 is stopped with the flat peripheral portions 48 lowermost and with a deposit item 124 positioned between the alignment rolls 100 and the spring biased balls 112. Under the control of the electronic control means 32, the motor 96 brings about rotation of the alignment rolls 100 in the course of an alignment operation, the rolls 100 being rotated first through one revolution in an anticlockwise direction (with reference to FIGS. 4 and 5) and then through two revolutions in a clockwise direction. As the rolls 100 rotate, the arcuate peripheral portions thereof come into cooperative relationship with the balls 112 so as to grip the deposit item 124 between these arcuate portions and the balls 112 with the balls 112 being moved slightly upwardly against the action of the springs 118, as shown in FIG. 5. As a result of being gripped between the alignment rolls 100 and the balls 112 during rotation of the rolls 100, the deposit item 124 is first moved transversely to the common feed path away from the reference surface 72 and into contact with a side surface 126 opposite the reference surface 72, and is then moved transversely to the common feed path towards the reference surface 72 so as to bring a long edge of the deposit item 124 into parallel abutting contact with the reference surface 72, the balls 112 rotating in their respective housings 116 during movement of the deposit item 124. It should be understood that the reason for moving the deposit item 124 first away from the reference surface 72 during an alignment operation is to assist in de-skewing the deposit item 124 if it has been inserted in the entry slot 14 with a badly skewed orientation, and to remove any curl in the long edge of the deposit item 124 nearer the reference surface 72. Still referring to FIGS. 4 and 5, the distance between the side surfaces 72 and 126 is 115 millimeters which is greater than the maximum width of a deposit item acceptable by the depository 10 and which is less than twice the minimum width of an acceptable deposit item. The distance between the upper surface of the table 88 and the lower surface of the plate member 84 is 7 millimeters which is slightly greater than the maximum thickness (6 millimeters) of a deposit item which can be inserted through the entry slot 14.

After the deposit item 124 has been moved into contact with the reference surface 72 as described above, rotation of the drive rolls 100 is stopped with the rolls 100 in their home positions, that is to say with the flat peripheral portions 102 uppermost and out of cooperative relationship with the balls 112. However, at this time the spring biased balls 112 remain in contact with the deposit item 124 and serve to retain the deposit item 124 in its correctly aligned position.

For a purpose which will be explained later, optical sensor means 128 are located at the entry to the alignment mechanism 46, and optical sensor means 130 are located at the opposite end of the alignment mechanism 46, adjacent to the end of the common feed path remote from the entry slot 14.

In operation of the depository apparatus 10, a user inserts his identification card into the card entry slot 18 and enters his PIN on the keyboard 20. A deposit transaction is then requested by the user using the control keys 22 and, if desired, he can request the ATM 12 to dispense an envelope, again by using the control keys 22. In response to the deposit transaction request being made, the shutter 28 is retracted by the actuating mechanism 30 and the user can then insert a deposit item into the entry slot 14. The deposit item is fed by the common transport section 34 through the thickness sensor 68 to the alignment mechanism 46. When the trailing edge of the deposit item passes the optical sensor 128 or when the leading edge of the deposit item is sensed by the optical sensor 130, whichever occurs first, then the common transport section 34 is stopped with the deposit item positioned approximately centrally with respect to the alignment mechanism 46 and with the flat peripheral portions 48 of the drive rolls 42 lowermost and out of contact with the deposit item.

If the thickness sensor 68 has sent an output signal to the electronic control means 32 indicating that the deposit item is an envelope, then, as previously described, the operation of the main transport motor 58 is reversed so as to cause the envelope to be fed by the transport section 34 into the envelope processing module 50. If the thickness sensor 68 has not sent an output signal to the electronic control means 32, thereby indicating that the deposit item is considered to be a single sheet document, then the common transport section 34 remains inoperative, and the alignment rolls 100 are rotated by the motor 96 under the control of the electronic control means 32. As previously described, the deposit item is first moved laterally by the rolls 100 towards the side face 126 and is then moved laterally towards the reference surface 72 so as to bring a long edge of the deposit item into parallel abutting contact with the surface 72. The rolls 100 are then stopped in their home position with the flat peripheral surfaces 102 uppermost and with the deposit item being held between the balls 112 and the table 88. With the alignment rolls 100 remaining inoperative, operation of the common transport section 34 is recommenced in a reverse sense to as to drive the deposit item back partly along the common feed path and into the document processing module 54, the divert gate 62 having previously been set to its actuated position as shown in dotted outline in FIG. 2B. The fact that the alignment mechanism 46 moved the deposit item laterally so as to bring a long edge of the deposit item into parallel abutting contact with the reference surface 72 will normally ensure that when the deposit item enters the document processing module 54 it is correctly aligned for proper processing by the module 54. It should be understood that one or more of the spring biased balls 112 remain in contact with the deposit item while it is being fed through the alignment mechanism 46 and until it leaves the mechanism 46, and this fact helps to ensure that the deposit item remains in contact with the reference surface 72 while being fed into the document processing module 54.

In alternative arrangements to that described above, the alignment mechanism 46 could include only two alignment rolls 100 and cooperating spring biased balls 112, or could incorporate four or more alignment rolls 100 and cooperating balls 112. What is important is that the alignment mechanism 46 should include at least two alignment rolls 100 spaced apart in a direction parallel to the common feed path and mounted with their axes non-perpendicular to (preferably substantially parallel to) this feed path.

The alignment mechanism 46 described above has the advantages that it is of simple construction and is able to bring a deposit item into parallel abutting relationship with the reference surface 72 by means of a single lateral movement of the deposit item towards the reference surface 72. Also, the spring biased balls 112 used for aligning documents do not impede the passage through the alignment mechanism 46 of envelopes (up to 6 millimeters thick) which do not require to be aligned. Moreover, the balls 112 help to retain an aligned document in contact with the reference surface 72.

What is claimed is:

1. A document alignment system comprising:

a feed path:

drive means having operative and non-operative modes of operation and when in said operative mode of operation, being effective to drive documents one by one along said feed path; and alignment means having a reference surface parallel to said feed path, and also having operative and non-operative modes of operation, and when in said operative mode of operation, being effective to move an edge of said document into parallel abutting contact with said reference surface;

said alignment means including:

a plurality of alignment rolls spaced apart in a direction parallel to said feed path and being mounted with their axes substantially parallel to said feed path; and a plurality of spring biased, rotatably mounted balls respectively arranged to cooperate with said alignment rolls;

said alignment rolls being effective to drive a document towards said reference surface with the document gripped resiliently between said alignment rolls and said balls when said alignment means is in said operative mode of operation; and said alignment means being in said operative mode of operation when said drive means is in said non-operative mode of operation, and said alignment means being in said non-operative mode of operation when said drive means is in said operative mode of operation.

2. The document alignment system as claimed in claim 1, in which each of said alignment rolls includes a flattened peripheral portion which is arranged to face the respective ball and to be out of contact therewith when said alignment means is in said inoperative mode of operation.

3. The document alignment system as claimed in claim 2 in which said feed path includes a guide plate having roll openings therein and in which said balls are arranged to hold a document present in said alignment means against said guide plate when said alignment means is in said inoperative mode of operation; and said alignment rolls being arranged to come into cooperative relationship with said balls via said roll openings in said guide plate.

4. The document alignment system as claimed in claim 3 in which said drive means includes:

a plurality of drive rolls and a plurality of idler rollers in cooperative relationship therewith;

each of said drive rolls including a flattened peripheral portion which is arranged to face the respective idler roller and to be out of contact therewith when said drive means is in said inoperative mode of operation.

5. The document alignment system as claimed in claim 4 in which said guide plate has a surface with roller openings therein and said idler rollers are partially accommodated in said roller openings in said guide plate, with a part of the periphery of each idler roll nearest the respective drive roll being substantially level with said surface of said guide plate.

6. The document alignment system as claimed in claim 5 further including a control means for controlling the operation of said document alignment system and for driving a document away from said reference surface before driving this document towards said reference surface during an alignment operation when said alignment means is in said operative mode of operation.

7. The document alignment system as claimed in claim 6 in which said alignment rolls have axes which are substantially parallel to said feed path.

8. The document alignment system as claimed in claim 7 in which each of said alignment rolls comprises an inner member of hard material around which is formed a sleeve of compressible rubber.

9. The document alignment system as claimed in claim 6 in which said drive means is enabled by said control means to drive a document in a first direction along said feed path prior to a said alignment operation taking place and to drive the document in the opposite direction along said feed path after said alignment operation has taken place.

10. The, document alignment system as claimed in claim 9 further comprising first and second sensors coupled to said control means and located adjacent to opposite ends of said alignment system in relation to said feed path, said second sensor being spaced from said first sensor in said first direction to enable said control means to stop said drive means prior to a said alignment operation being carried out in response to said first sensor sensing a trailing edge of a document or in response to said second sensor sensing a leading edge of this document, whichever occurs first.

* * * * *